US006688599B1

(12) United States Patent
Manalili

(10) Patent No.: US 6,688,599 B1
(45) Date of Patent: Feb. 10, 2004

(54) CASINO GAME AND METHOD

(76) Inventor: Michael Manalili, 5117 Marita Dr., Antioch, CA (US) 94509

( * ) Notice: Subject to any disclaimer, the term of this patent is extended or adjusted under 35 U.S.C. 154(b) by 0 days.

(21) Appl. No.: 10/147,943

(22) Filed: May 17, 2002

(51) Int. Cl.[7] ..... A63F 1/00

(52) U.S. Cl. ..... 273/303; 273/292; 273/274; 273/309

(58) Field of Search ..... 273/303, 306, 273/292, 274

(56) References Cited

U.S. PATENT DOCUMENTS 4,955,619 A * 9/1990 Christman ..... 273/273
5,314,193 A * 5/1994 Ferrer ..... 273/292
5,366,228 A * 11/1994 Kangsanaraks ..... 273/292
5,368,305 A * 11/1994 Rodda et al. ..... 273/292
5,397,128 A * 3/1995 Hesse et al. ..... 273/292
5,407,208 A * 4/1995 Keller et al. ..... 273/274
5,411,268 A * 5/1995 Nelson et al. ..... 273/292
5,549,300 A * 8/1996 Sardarian ..... 273/292
5,632,486 A * 5/1997 Mkrtchyan ..... 273/292
5,632,487 A * 5/1997 Nguyen ..... 273/292
5,676,375 A * 10/1997 Pirouzkhah ..... 273/274
5,725,215 A * 3/1998 Hesse ..... 273/292
5,879,007 A * 3/1999 Kasri ..... 273/292
6,299,171 B1 * 10/2001 Mollo et al. ..... 273/292
6,341,778 B1 * 1/2002 Lee ..... 273/292

* cited by examiner

*Primary Examiner*—Benjamin H. Layno
*Assistant Examiner*—Dolores Collins
(74) *Attorney, Agent, or Firm*—Charles L. Thoeming

(57) ABSTRACT

A method of playing an improved casino game of chance and skill under which a player can play either 1) a house hand or a guest hand, or 2) directly against the dealer. For either embodiment, the object of the game is to maximize the point total represented by the differential values of two (2) dealt cards up to a maximum target of eleven. One card discards consistent with predetermined house rules are required or allowed, depending on the embodiment. Additional wagers on ties, three of a kind or royal families can be made consistent with the respective rules for each embodiment. The game can be enjoyed as friendly competition or in legalized gambling settings, and as face-to-face play, online computerized play, or computerized electronic gaming machine play.

11 Claims, 2 Drawing Sheets

CASINO GAME AND METHOD

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention consists of a game of chance and skill presenting embodiments wherein a player can play either 1) the house hand or a guest hand, or 2) directly against the dealer. For both options, the object of the game is to maximize the point total represented by the differential values of two (2) dealt cards. A one card discard is either mandatory or elective depending upon the embodiment and the face values of the two cards dealt. The game can be enjoyed as friendly competition or in legalized gambling settings in face-to-face, online, or electronic game play.

2. Description of the Related Art

A search of the prior art located the following United States patents which are believed to be representative of the present state of the prior art: U.S. Pat. No. 6,299,171 B1, issued Oct. 9, 2001, U.S. Pat. No. 5,879,007, issued Mar. 9, 1999, U.S. Pat. No. 5,725,215, issued Mar. 10, 1998, U.S. Pat. No. 5,676,375, issued Oct. 14, 1997, U.S. Pat. No. 5,632,486, issued May 27, 1997, and U.S. Pat. No. 5,549,300, issued Aug. 27, 1996.

BRIEF SUMMARY OF THE INVENTION

The present invention consists of an improved game of chance and skill under which a player can play either 1) a house hand or a guest hand, or 2) directly against the dealer. For either embodiment, the object of the game is to maximize the point total represented by the differential values of two (2) dealt cards up to a predetermined maximum target. A one card discard is either mandatory or elective depending upon the embodiment and the face values of the two cards dealt. The game can be enjoyed as friendly competition or in legalized gambling settings in face-to-face, online, or electronic game play.

Prior art principally focuses on rules wherein hands are evaluated by adding the card point values to a blackjack like result, such a U.S. Pat. No. 5,549,300. This approach lengthens the play of each hand, and can minimize the speed of play and discourage the novice player from pure chance participation. Some prior art combines dice and cards as a means of varying the target point total as described in U.S. Pat. No. 5,676,375. This approach adds steps and time to each hand played. These additional steps and the time taken for them deter application of such art by gaming houses which tend to prefer quick paced games and serve as a barrier to novice players who may not accept the additional complexity presented by such gaming methods.

Prior art blackjack games that calculate point total by subtraction award the lowest point total, as in U.S. Pat. No. 5,632,486. This approach does not use all cards in a standard deck and also presents an unusual barrier to participation for both the novice and experienced player in this regard. Further, this approach also complicates the gaming preparation and adds unnecessary steps to the method of play as the art described above.

One embodiment of the present invention principally involves an improved baccarat-type card game of chance. For this option, the dealer discards the first card which is void and kept face down. The first and third cards dealt after the initial discard are in drawn to the guest's hand, while the house's hand draws the second and fourth card. All cards drawn are face up. Cards are counted by their numerical values. Face cards are counted as zero. Aces count either one (1) or eleven (11), depending which provides the highest point total. Both hands are forced to change a card at six (6) points or less or with a combination of an ace card and an eight card or a four card, which constitutes a "soft seven". Both hands must stand at seven (7) points or more. After changing a card, one (1) replacement card is drawn which makes the final point total. Both hands are required to follow the house rules in changing cards. The guest's hand is the first to change a card, followed by the house's hand. Changing cards is done only once. Eleven (11) points is the highest possible numerical point value per hand; however it loses to three of a kind (called a "Trio") or a royal family (a set of king, queen and jack of the same suit). If both hands are equal in final points or are a Trio or royal family, a tie is declared. A zero (0) final point total on a guest's hand automatically loses to the house's hand. Specified "house rules" dictating the card changing regimen are provided in the present invention.

A second embodiment presents an improved blackjack-type card game combining a mixture of chance and skill to up to seven players against a dealer's hand. The procedure is the same as for the first option; however, the second card to the dealer is face down. A second set of house rules is applied consistent with the gaming and wagering aspect of this second embodiment.

Various wagering multiples can be assigned the outcomes for each option depending upon the legalized betting venue and customs.

It is an object of the present invention to provide a casino game which is easy to learn.

It is yet another object of the present invention to provide a casino game which is fun to play for both the novice and experience game player.

It is yet a further objective of the present invention to provide a casino game which is plays quickly, thus providing an attractive feature to both gaming institutions and participants.

It is still further an objective of the present invention to provide a casino game which may be appreciated by both skill players and chance players.

Other features, advantages, and objects of the present invention will become apparent with reference to the following description and accompanying drawings.

DETAILED DESCRIPTION OF THE INVENTION

Figure 1:
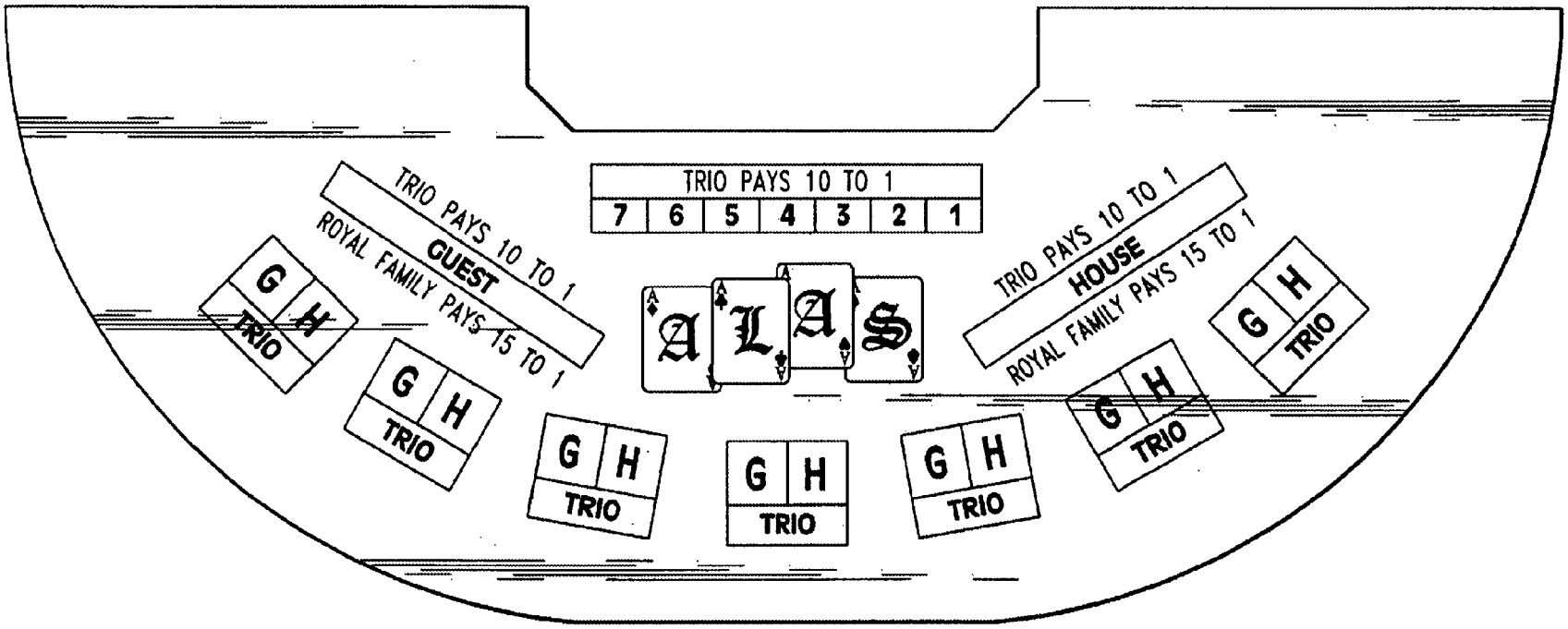
FIG. 1 is a gaming table layout for an embodiment of the present invention wherein the player places a wager on either the guest hand position or house hand position and wherein the various wagering blocks for wagers for the embodiment of chance between the house hand and the guest hand are depicted.

Derivation of House Rules in Changing Cards

The following sections A through H demonstrate the multiple two-card combinations available under the present invention and application of the house rules of the present invention are provided for each such combination as a means to demonstrate the derivation of the rules and as a basis for the user to understand how the game of the present invention is played according to the various embodiments described in this specification. The differential values provided for each example of changing a card subtracts the remaining card value from each of the possible, potential new cards to be drawn; the changed card is not used and is no longer part of the game.

The method used is by process of elimination and combinations with reference to the assigned value of the respective cards. Reference # 1 is the guide for performing the derivation of the house rules in changing cards.

REFERENCE # 1

0 0 0 1 2 3 4 5 6 7 8 9 10 11

In Reference #1, the three zeroes indicate the face card values. 1 and 11 represent the alternative values for the ace card.

(A) Cards with a Difference of 1 Point

1. Combination of card 2 and card 3;

Using Reference # 1

Points available to increase the difference between two cards to more than 1 point;

Changing Card 2

3,3,3,2,3,4,5,6,7 and 8 points available;

Changing Card 3

2,2,2,2,3,4,5,6,7,8 and 9 points available.

Therefore, change card 3 which will yield more points greater than 1.

1. Combination of card 3 and card 4;

Using Reference # 1

Points available to increase the difference between two cards to more than 1 point;

Changing Card 3

2,4,4,4,2,3,4,5,6 and 7 points available;

Changing Card 4

3,3,3,2,3,4,5,6,7_and 8 points available.

Therefore, change card 4 to yield more points greater than 1.

3. Combination of card 4 and card 5;

Using Reference # 1

Points available to increase the difference between two cards to more than 1 point;

Changing Card 4

3,5,5,5,2,3,4,5 and 6 points available;

Changing Card 5

2,4,4,4,2,3,4,5,6 and 7 points available.

Therefore, change card 5 to yield more points greater than 1.

4. Combination of card 5 and card 6;

Using Reference # 1

Points available to increase the difference between two cards to more than 1 point;

Changing Card 5

2,3,5,5,5,2,3,4,5_and 6 points available;

Changing Card 6

2,3,4,5,5,5,2,3,4 and 5 points available.

Therefore, change card 5 to yield more points greater than 1.

5. Combination of card 6 and card 7;

Using Reference # 1

Points available to increase the difference between two cards to more than 1 point;

Changing Card 6

2,3,4,5,6,7,7,7,2 and 3 points available;

Changing Card 7

2,3,4,5,6,6,6,2,3 and 4 points available.

Therefore, change card 6 to yield more points greater than 1.

6. Combination of card 7 and card 8;

Using Reference # 1

Points available to increase the difference between two cards to more than 1 point;

Changing Card 7

2,3,4,5,6,7,8,8,8 and 2 points available;

Changing Card 8

2,3,4,5,6,7,8,8,8 and 2 points available.

Therefore, change card 7 to yield more points greater than 1.

7. Combination of card 8 and card 9:

Using Reference # 1

Points available to increase the difference between two cards to more than 1 point;

Changing Card 8

2,3,4,5,6,7,8,9,9 and 9 points available;

Changing Card 9

2,3,4,5,6,7,8,8,8 and 2 points available.

Therefore, change card 8 to yield more points greater than 1.

8. Combination of card 9 and card 10;

Using Reference # 1

Points available to increase the difference between two cards to more than 1 point;

Changing Card 9

2,3,4,5,6,7,8,9,10,10 and 10 points available;

Changing Card 10

2,3,4,5,6,7,8,9,9 and 9 points available.

Therefore, change card 9 to yield more points greater than 1.

(B) Cards with a Difference of Two Points

1. Combination of card 2 and card 4;

Using Reference # 1

Points available to increase the difference between two cards to more than 2 points;

Changing Card 2

4,4,4,2,3,4,5, _and 6 points available;

Changing Card 4

3,4,5,6,7,8 and 9 points available.

Therefore, change card 4 to yield more points greater than 2.

2. Combination of card 3 and card 5;

Using Reference # 1

Points available to increase the difference between two cards to more than 2 points;

Changing Card 3

3,5,5,5,3,4,5 and 6 points available;

Changing Card 5

3,3,3,3,4,5,6,7 and 8 points available.

Therefore, change card 5 to yield more points greater than 2.

3. Combination of card 4 and card 6;
Using Reference # 1
Points available to increase the difference between two cards to more than 2 points;
Changing Card 4
3,4,5,6,6,6,3 and 4 points available;
Changing Card 6
4,4,4,3,4,5,6 and 7 points available.
Therefore, change card 6 to yield more points greater than 2.
4. Combination of card 5 and card 7;
Using Reference # 1
Points available to increase the difference between two cards to more than 2 points;
Changing Card 5
3,4,5,6,7,7,7 and 3 points available;
Changing Card 7
3,5,5,5,3,4,5 and 6 points available.
Therefore, change card 5 to yield more points greater than 2.
5. Combination of card 6 and card 8;
Using Reference # 1
Points available to increase the difference between two cards to more than 2 points;
Changing Card 6
3,4,5,6,7,8,8 and 8 points available;
Changing Card 8
3,4,5,6,6,6,3 and 4 points available.
Therefore, change card 6 to yield more points greater than 2.
6. Combination of card 7 and card 9;
Using Reference # 1
Points available to increase the difference between two cards to more than 2 points;
Changing Card 7
3,4,5,6,7,8,9,9 and 9 points available;
Changing Card 9
3,4,5,6,7,7,7 and 3 points available.
Therefore, change card 7 to yield more points greater than 2.
7. Combination of card 8 and card 10;
Using Reference # 1
Points available to increase the difference between two cards to more than 2 points;
Changing Card 8
3,4,5,6,7,8,9,10,10 and 10 points available;
Changing Card 10
3,4,5,6,7,8,8 and 8 points available;
Therefore, change card 8 to yield more points greater than 2.
(C). Cards with a Difference of 3 Points
1. Combination of card 2 and card 5
Using Reference # 1
Points available to increase the difference between two cards to more than 3 points;
Changing Card 2
5,5,5,4,5 and 6 points available;
Changing Card 5
4,5,6,7,8 and 9 points available.
Therefore, change card 5 to yield more points greater than 3.
2. Combination of card 3 and card 6;
Using Reference # 1
Points available to increase the difference between two cards to more than 3 points;
Changing Card 3
4,5,6,6,6 and 4 points available;
Changing Card 6
4,5,6,7 and 8 points available.
Therefore, change card 6 to yield more points greater than 3.
3. Combination of card 4 and card 7;
Using Reference # 1
Points available to increase the difference between two cards to more than 3 points;
Changing Card 4
4,5,6,7,7,7 and 4 points available;
Changing Card 7
4,5,6,7,4,4 and 4 points available.
Therefore, change card 4 to yield more points greater than 3.
4. Combination of card 5 and card 8;
Using Reference # 1
Points available to increase the difference between two cards to more than 3 points;
Changing Card 5
4,5,6,7,8,8 and 8 points available;
Changing Card 8
4,5,6,5,5 and 5 points available.
Therefore, change card 5 to yield more points greater than 3.
5. Combination of card 6 and card 9;
Using Reference # 1
Points available to increase the difference between two cards to more than 3 points;
Changing Card 6
4,5,6,7,8,9,9 and 9 points available;
Changing Card 9
4,5,6,6,6 and 4 points available.
Therefore, change card 6 to yield more points greater than 3.
6. Combination of card 7 and card 10;
Using Reference # 1
Points available to increase the difference between two cards to more than 3 points;
Changing Card 7
4,5,6,7,8,9,10,10 and 10 points available;
Changing Card 10
4,5,6,7,7 and 7 points available.
Therefore, change card 7 to yield more points greater than 3.
(D) Cards with a Difference of 4 Points
1. Combination of card 2 and card 6;
Using Reference # 1
Points available to increase the difference between two cards to more than 4 points;
Changing Card 2
5,6,6 and 6 points available;
Changing Card 6
5,6,7,8 and 9 points available.
Therefore, change card 6 to yield more points greater than 4.
2. Combination of card 3 and card 7;
Using Reference # 1
Points available to increase the difference between two cards to more than 4 points;
Changing Card 3
5,6,7,7 and 7 points available;
Changing Card 7
5,6,7 and 8 points available.
Therefore, change card 3 except if the player's lowest points is 8 points, then change card 7.
3. Combination of card 4 and card 8;

Using Reference # 1

Points available to increase the difference between two cards to more than 4 points;

Changing Card 4

5,6,7,8,8 and 8 points available;

Changing Card 8

5,6 and 7 points available.

Therefore, change card 4 to yield more points greater than 4

4. Combination of card 5 and card 9;

Using Reference # 1

Points available to increase the difference between two cards to more than 4 points;

Changing Card 5

5,6,7,8,9,9 and 9 points available;

Changing Card 9

5,5,5,5 and 6 points.

Therefore, change card 5 to yield more points greater than 4.

5. Combination of card 6 and card 10;

Using Reference # 1

Points available to increase the difference between two cards to more than 4 points;

Changing Card 6

5,6,7,8,9,10,10 and 10 points available;

Changing Card 10

5,6,6 and 6 points available.

Therefore, change card 6 to yield more points greater than 4.

(E) Cards with a Difference of 5 Points

1. Combination of card 2 and card 7;

Using Reference # 1

Points available to increase the difference between two cards to more than 5 points;

Changing Card 2

6,7,7 and 7 points available;

Changing Card 7

6,7,8 and 9 points.

Therefore, change card 7 to yield more points greater than 5.

2. Combination of card 3 and card 8;

Using Reference # 1

Points available to increase the difference between two cards to more than 5 points;

Changing Card 3

6,7,8,8 and 8 points available;

Changing Card 8

6,7 and 8 points available.

Therefore, change card 3 to yield more points greater than 5.

3. Combination of card 4 and card 9;

Using Reference # 1

Points available to increase the difference between two cards to more than 5 points Changing Card 4

6,7,8,9,9 and 9 points available;

Changing Card 9

6 and 7 points available.

Therefore, change card 4 to yield more points greater than 5.

4. Combination of card 5 and card 10;

Using Reference # 1

Points available to increase the difference between two cards to more than 5 points;

Changing Card 5

6,7,8,9,10,10 and 10 points available

Changing Card 10

6 points

Therefore, change card 5 to yield more points greater than 5.

(F) Cards with a Difference of 6 Points

1. Combination of card 2 and card 8;

Using Reference # 1

Points available to increase the difference between two cards to more than 6 points;

Changing Card 2

7,8,8 and 8 points;

Changing Card 8

7,8 and 9 points.

Therefore, change card 2 except if the lowest points of the players is 9 points change card 8 to yield more points greater than 6.

2. Combination of card 3 and card 9;

Using Reference # 1

Points available to increase the difference between two cards to more than 6 points;

Changing Card 3

7,8,9,9 and 9 points;

Changing Card 9

7 and 8 points.

Therefore, change card 3 to yield more points greater than 6.

3. Combination of card 4 and card 10;

Using Reference # 1

Points available to increase the difference between two cards to more than 6 points;

Changing Card 4

7,8,9,10,10 and 10 points available;

Changing Card 10

7 points available.

Therefore, change 4 to yield more points greater than 6.

(G) Combination of a Face card and Cards 2,3,4,5 and card 6

1. Combination of any Face card and card 2;

Using Reference #1

Points available to increase the difference between two cards to more than 2;

Changing Card 2

3,4,5,6,7,8,9,10 and 11 points available;

Changing the Face Card 3,4,5,6,7,8 and 9 points available.

Therefore, change card 2 to yield more points greater than 2.

2. Combination of any face card and card 3;

Using Reference #1

Points available to increase the difference between two cards to more than 3;

Changing Card 3

4,5,6,7,8,10 and 11 points available;

Changing the Face Card 4,5,6,7 and 8 points.

Therefore, change card 3 to yield more points greater than 3.

3. Combination of any Face card and card 4;

Using Reference #1

Points available to increase the difference between two cards to more than 4;

Changing Card 4

5,6,7,8,9,10 and 11 points available;

Changing the Face Card 5,6 and 7 points available.

Therefore, change card 4 to yield more points greater than 4.

4. Combination of any Face card and card 5;

Using Reference #1

Points available to increase the difference between two cards to more than 5;

Changing Card 5

6,7,8,9,10 and 11 points available;

Changing the Face Card 6 points available.

Therefore, change card 5 to yield more points greater than 5.

5. Combination of any Face card and card 6;

Using Reference #1

Points available to increase the difference between two cards to more than 6;

Changing Card 6

7,8,9 and 10 points available;

Changing the Face Card

No points available (H) Combination of Any Ace Card and Cards 5,6, and Card 7

1. Combination of an Ace and card 5;

Using Reference #1

Points available to increase the difference between two cards to more than 6;

Changing Card 5

7,8,9,10,11,11 and 11 points available;

Changing the Ace Card

No points available.

Therefore, change card 5 to yield more points greater than 6.

2. Combination of an Ace and card 6;

Using Reference #1

Points available to increase the difference between two cards to more than 5;

Changing Card 6

6,7,8,9,10,11,11 and 11 points available;

Changing the Ace Card 6,6 and 6 points available.

Therefore, change card 6 to yield more points greater than 5.

3. Combination of an Ace card and card 7;

Using Reference #1

Points available to increase the difference between two cards to more than 6;

Changing Card 7

7,8,9,10,11,11 and 11 points available;

Changing the Ace 7,7 and 7 points available.

Therefore, change card 7 to yield more points greater than 6.

ONE EMBODIMENT OF THE PRESENT INVENTION

In a first embodiment of the present invention, a player can play either the house hand or the guest hand. Before play is begun, a dealer or croupier is selected or established under the particular casino procedure which is beyond the scope of the present invention and well known in the art. Once a dealer or croupier is selected, up to seven game players are seated at the gaming table depicted by FIG. 1. At least one player is provided up to a total of seven maximum players. Each player places a wager on one of a house's hand to win or on a guest hand to win, or on a tie between a guest's hand and the house's hand. In this embodiment of the present invention, it is important to note that the house hand and the guest hand are separate playing hands, and that the player(s) can exercise one of two betting options by placing a bet on either the house hand or on the guest hand to win. The players for this embodiment are merely playing the game of chance as to the outcome of whichever of the respective betting hands they select for the purpose of wagering. The house/guest hand pairing is judged on the final two cards for that pairing according to the house rules as developed herein wherein the differential is always measured between the two cards in play, and that any changed card is no longer part of the game.

Although the present card game invention can be played by individuals at a table for face-to-face play and direct wagering, embodiments of the present invention can be enjoyed as an on-line game among participating players within computer controlled game-rooms or by players using electronic gaming machines.

At least one standard deck of cards comprising a four by thirteen array wherein four different suits are arranged in ascending order by numerical indicia wherein each suit has thirteen cards corresponding in order from ace through ten, and three face cards, jack, queen, and king is provided for play. Up to eight (8) standard decks may be used at one time consistent with the particular preferences of the gaming establishment in dissuading card counting consistent with known practices in the art.

A predetermined value is assigned to each card with the deuce through ten having values of two through ten respectively, the ace having either a value of one or eleven whichever would give the higher value to a hand, and all face cards of each suit having a value of zero. The dealer shuffles the deck(s) so as to randomly mix the array of cards.

The game is begun by the dealer dealing the first card from the shuffled deck(s) face down as a void card. After the void card is dealt, the dealer then deals to the guest hand the first and third card, wherein the cards dealt to the guest hand are all face up. The dealer deals to the house hand the second and fourth card, wherein the cards dealt to the house are all face up. Bets are placed in the respective betting boxes as shown in FIG. 1. Royal family bets are placed in the same betting box as trio bets for this embodiment. Bets for either royal family or trio are not placed until after the guest and house hands have been dealt.

The house rules for changing cards for this embodiment as derived from the foregoing examples are as follows:

1. For any two card combination of cards 2, card 3 and card 4 change the higher numerical card value.

Examples

Card 4 and card 2 change card 4;

Card 4 and card 3 change card 4;

Card 3 and card 2 change card 3.

2. Any card paired with a face card or an Ace change the card.

Examples

An Ace and card 7 change card 7;

A Queen and card 4 change card 4;

A King and card 3 change card 3.

3. Any card paired with card 5 or card 6, change card 5 or card 6. In case card 5 is paired with card 6 change card 5.

Examples

Card 9 and card 5 change card 5;

Card 8 and card 6 change card 6;

Card 7 and card 5 change card 5.

4. All other card combinations not mentioned above change the Card with a lower numerical card value.

Exemptions

Card 7 and card 2 change card 7;

Card 8 and card 2 change card 2, except if the points of the Guest's hand or House's hand is 9 points change card 8;

Card 7 and card 3 change card 3, except if the points of the Guest's hand or the House's hand is 8 points change card 7;

Examples

Card 8 and card 4 change card 4;

Card 9 and card 3 change card 3;

Card 10 and card 4 change card 4;

Card 10 and card 8 change card 8.

The values for the hands are counted by subtracting the differing numerical values of the two cards according to the predetermined values assigned. Each player is allowed to place wagers on one of a house hand to win, or on a guest hand to win, or on a tie between a guest hand and the house hand before changing cards and drawing a replacement card consistent with the house rules of the present invention as set forth herein. Any hand with six points or less is forced to change a card. A hand with seven points or more is forced to stand. Any hand with a combination of an ace card and 8 card or a four card is considered a "soft seven" and must change a card. As further provided under the house rules, any card paired with an ace or face card is forced to change the card. Also, any card paired with either a five or six, the five or six is force to be changed. For any two card combination of two, three or four, the higher numerical card is forced to be changed, as shown in the derivation of house rules. For all other card combinations, the card with a lower numerical value is forced to be changed.

A natural death is declared if either the guest's hand or the house's hand initial points seems impossible to win over the other's hand wherein the losing hand automatically loses its wager.

According to the house rules, cards are changed if appropriate, first for the guest's hand and then for the house's hand.

The winning hand is determined by comparing hands, wherein the winning hand is the hand with the higher point total with eleven being the maximum total points possible under the present invention, and wherein a set of three of a kind cards, or trio, or a set of face cards from the same suit, or royal family, beat the highest point total. A draw or tie is declared in the event both the guest's hand and the house's hand have the same point total or both are a trio or royal family. An automatic loss to the house hand is declared if the guest hand's final point total is zero.

Based upon the present invention the winning status is declared. Each player is paid the respective wager for each winning hand at the rate of even on the guest hand and even less the house commission, normally five (5%) percent, on the house hand. Successful tie wagers pay at 8 to 1. Successful trio wagers pay 10 to 1. Successful royal family wagers pay at 15 to 1. The house is paid the respective player wager for each losing hand wager, unsuccessful tie wager, unsuccessful trio wager, or unsuccessful royal family wager.

ANOTHER EMBODIMENT OF THE PRESENT INVENTION

Figure 2:
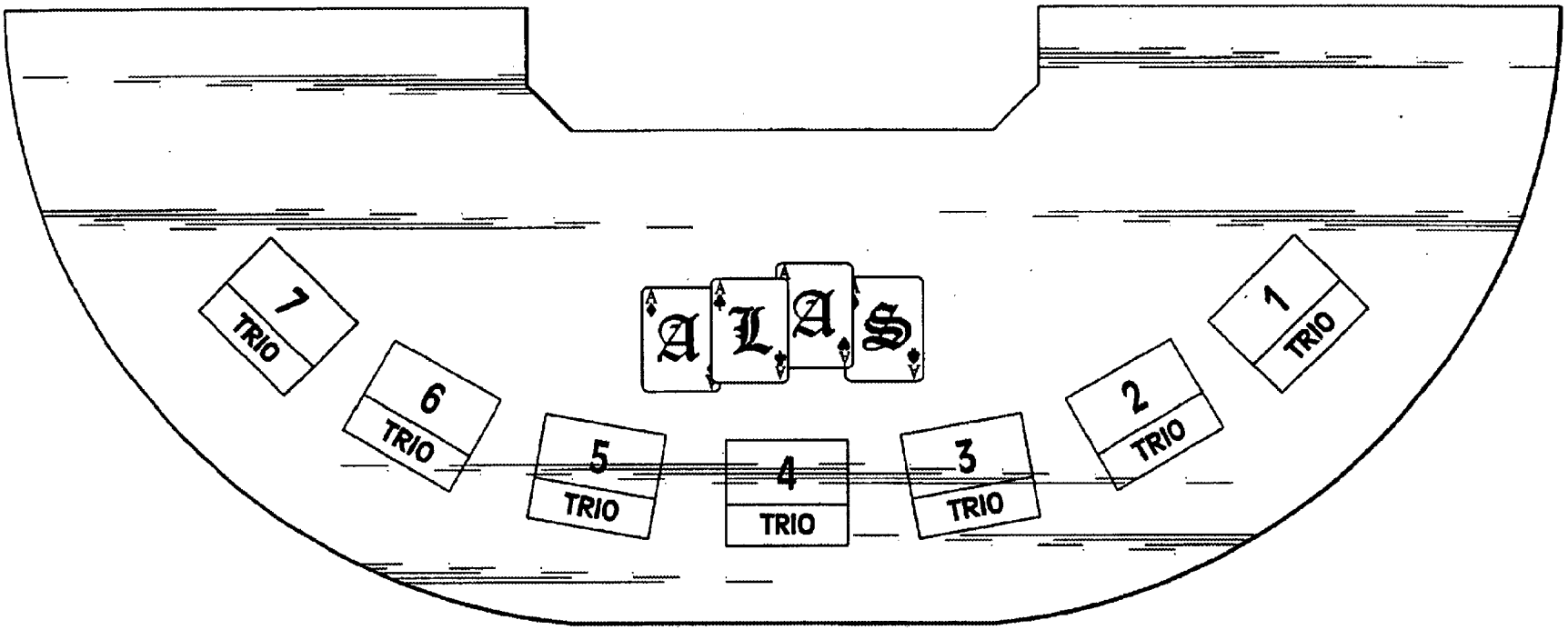
FIG. 2 is a gaming table layout for an embodiment of the present invention wherein the player places a wager on a the player's game with a dealer and wherein the various wagering blocks for wagers for the embodiment of skill between the player and the house are depicted.

Another embodiment of the present invention for an improved casino card game and method comprises providing a dealer and providing up to seven players in the gaming table layout depicted in FIG. 2.

Each player is allowed to place wagers on his or her own player's hand to win. It is important to note that in this embodiment of the present invention the player has control over his or her hand for purposes of selecting whether to change cards, and the player is playing against the house hand.

At least one standard deck of cards comprising a four by thirteen array wherein four different suits are arranged in ascending order by numerical indicia wherein each suit has thirteen cards corresponding in order from ace through ten, and three face cards, jack, queen, and king is provided. Up to eight (8) standard decks may be used at one time consistent with the particular preferences of the gaming establishment in dissuading card counting consistent with known practices in the art.

A predetermined value is assigned to each card with the deuce through ten having values of two through ten respectively, the ace having either a value of one or eleven whichever would give the higher value to a hand, and all face cards of each suit having a value of zero. The deck is shuffled so as to randomly mix the array of cards.

The game is begun by dealing the first card from the shuffled deck(s) face down as a void card. The dealer then deals each player a first card in clockwise succession beginning with the first player until all players have a first card face up. The dealer then deals himself a first card face up. The dealer then deals each player a second card in clockwise succession beginning with the first player until all players have a two card hand consisting of first card and second card both face up. The dealer then deals himself a second card face down, wherein the dealer's hand consists of a first card face up and a second card face down.

Bets are placed in the respective betting boxes as shown in FIG. 2. Royal family bets are placed in the same betting box as trio bets for this embodiment. Betting for a royal family or trio does not occur until after the players' and dealer's hands have been dealt.

The house rules for changing cards for this embodiment as derived from the foregoing examples are as follows:

1. For any two card combination of card 2, card 3 and card 4, change the higher numerical card value.

Examples

Card 4 and card 2 change card 4;

Card 4 and card 3 change card 4;

Card 3 and card 2 change card 3.

2. Any card paired with a face card or an Ace, change the card.

Examples

An Ace and card 7 change card 7;

A Queen and card 4 change card 4;

A King and card 3 change card 3.

3. Any card paired with card 5 or card 6, change card 5 or card 6. In case card 5 is paired with card 6, change card 5.

Examples

Card 9 and card 5 change card 5;

Card 8 and card 6 change card 6;

Card 7 and card 5 change card 5.

4. All other card combinations not mentioned above change the Card with a lower numerical card value.

Exemptions

Card 7 and card 2 change card 7;

Card 8 and card 2 change card 2, except if the lowest points of the player is 9 points, then change card 8; and Card 7 and card 3 change card 3, except if the lowest points of the player is 8 points, then change card 7.

Examples

Card 8 and card 4 change card 4;

Card 9 and card 3 change card 3;

Card 10 and card 4 change card 4; and

Card 10 and card 8 change card 8.

Each player is allowed to place additional wagers on the respective player's hand to win before changing cards and drawing a replacement card consistent with the house rules of the present invention. Each player is allowed to stay or change one card as the player desires based upon the player's personal assessment of his chances against the dealer's hand. A dealer's hand with a combination of an ace card and 8 card or a four card is considered a "soft seven" and must change a card. A dealer's hand with six points or less is forced to change a card. The dealer's hand with seven points or more is forced to stand.

The winning hand for each player is declared by comparing the respective hands between each player and the dealer. The winning hand is the hand with the higher point total with eleven being the maximum total points possible under the present invention. A set of three of a kind cards, or trio, or a set of face cards from the same suit, or royal family, beat the highest point total. A draw or tie is declared in the event both the player's hand and the dealer's hand have the same point total or both are a trio or royal family. In the case of a tie, the respective bets are retained in the betting box for the next hand's play and become added to the betting totals going forward. An automatic loss to the dealer is declared if the player's final point total is zero.

The winning status for each player is declared. Each player is paid the respective wager for each winning player wager on the player's hand, successful trio wager 10 to 1, or successful royal family wager at 15 to 1. The dealer is paid the respective wager for each losing game player hand, unsuccessful trio wager, or unsuccessful royal family wager.

Based upon computer simulations of 1.1 billion times the game and method of the present invention was played (1,163,715,615 hands played) the percentage of house wins was 45.4%, the percentage of quest wins was 45.3%, and the percentage of ties was 9.3%. The percentage of possible royal families was 1.78%. The percentage of possible trios was 13.79%. The percentage of wins on royal families was 1.93%. The percentage of wins on trios was 7.25%.

For these 1.1 billion hands, the house edge on a guest hand was 0.09%. The house edge on a house hand was 2.18%. The house edge on a tie hand was 16.14%. The house edge on a trio hand was 20.21%. The house edge on a royal family was 69.14%.

The principles of the present card game invention have been clearly presented in the preceding illustrative and explanatory text; however, those skilled in the art may make any modifications in the modes of play and array configurations of the invention without departing from those principles. It is intended, therefore, that the description and drawings be considered and interpreted as illustrative and not merely limiting, and that the present card game invention be given a scope commensurate with the appended claims.

I claim:

1. An improved casino card game and method using from one to eight standard decks of cards wherein a plurality of players wager on one of two hands, either a house hand or a quest hand, to have more points up to a maximum point total of eleven, wherein points are determined by subtracting the differences between the two cards per hand according to predetermined values for each card and allowing one card discard and redraw according to predetermined house rules, wherein discarded cards are no longer part of the game, said method further comprising the steps of:

a) providing the quest hand position;

b) providing the house hand position;

c) providing up to seven players;

d) providing a dealer;

e) providing at least one, but not more than eight, standard deck(s) of cards, each deck comprising a four by thirteen array wherein four different suits are arranged in ascending order by numerical indicia wherein each suit has thirteen cards corresponding in order from ace through ten, and three face cards, jack, queen, and king;

f) assigning a predetermined value to each card with the deuce through ten having values of two through ten respectively, the ace having either a value of one or eleven whichever would give the higher value to a hand, and all face cards of each suit having a value of zero;

g) shuffling the deck(s) so as to randomly mix the array of cards;

h) allowing the players to place bets on the house hand or the quest hand to win or on a tie between the house and quest hand;

i) dealing the first card from the shuffled deck(s) face down as a void card;

j) dealing to the quest hand a first card, wherein the card is face up;

k) dealing to the house hand a first card, wherein the card is face up;

l) dealing to the quest hand a second card, wherein the card is face up;

m) dealing to the house hand a second card, wherein the card is face up;

n) counting the values for the quest and house hands by subtracting the differing numerical values of the two cards in each hand according to the predetermined values assigned;

o) allowing each player to place additional wagers on (i) either the quest or the house hand to win, (ii) either the quest or house hand to hold three of a kind or trio, (iii) either the quest or house hand to contain a set of face cards from the same suit or royal family, or (iv) on a tie between the quest hand and the house hand before changing cards and drawing a replacement card consistent with house rules for the present invention;

p) declaring a natural death if either the quest hand or the house hand initial points seem impossible to win over the other hand wherein the losing hand automatically loses its wager;

g) changing cards if appropriate, first for the quest hand and then for the house hand according to the house rules for the present invention;

r) determining the wining hand by comparing hands, wherein the winning hand is the hand with the higher point total for the two existing cards in each hand, any changed card no longer being part of the game, with eleven being the maximum total points possible under the present invention, and wherein a set of three of a kind cards, or trio, or a set of face cards from the same suit, or royal family, beat the highest point total;

s) declaring a draw or tie in the event both the quest hand and the house hand have the same point total or both are a trio or royal family;

t) declaring an automatic loss to the house if the quest hand final point total is zero;

u) awarding the winning status for the hand;

v) paying each player for each winning wager; and w) paying the house for each unsuccessful player wager; wherein the house rules further comprise:

1) for any two card combination of card 2, card 3 and card 4 change the higher numerical card value;

2) for any card paired with a face card or an Ace change the card;

3) for any card paired with card 5 or card 6, change card 5 or card 6, and if card 5 is paired with card 6 change card 5;

4) for all other card combinations not mentioned above change the card with a lower numerical card value, with the following exemptions:

i) card 7 and card 2, then change card 7;

ii) card 8 and card 2, change card 2, except if the points of the guest hand or house hand equal 9 points, then change card 8; and iii) card 7 and card 3, then change card 3, except if the points of the guest hand or the house hand equal 8 points, then change card 7.

2. The improved casino card game and method of claim 1, wherein winning player wagers are paid (i) even money for each winning wager on a guest hand, (ii) even money less a house commission for each winning wager on a house hand, (iii) 8 to 1 for each successful tie wager, (iv) 10 to 1 for each successful trio wager, and (v) 15 to 1 for each successful royal family wager.

3. The improved casino card game and method of claim 2, wherein the house commission is five (5%) percent.

4. The improved casino card game and method of claim 3 using computer generated play, wherein up to seven players participate on-line with computer generated guest and house hands.

5. The improved casino card game and method of claim 3 using computer generated play, wherein each players participates on an electronic gaming machine with computer generated guest and house hands.

6. An improved casino card game and method using from one to eight standard decks of cards wherein a plurality of players wager on one of two hands, either a house hand or a quest hand, to have more points up to a maximum point total of eleven, wherein points are determined by subtracting the differences between the two cards per hand according to predetermined values for each card and allowing one card discard and redraw according to predetermined house rules, wherein discarded cards are no longer part of the game, said method further comprising the steps of:

a) providing a dealer;

b) providing up to seven players;

c) providing at least one, but not more than eight, standard deck(s) of cards, each deck comprising a four by thirteen array wherein four different suits are arranged in ascending order by numerical indicia wherein each suit has thirteen cards corresponding in order from ace through ten, and three face cards, lack, queen, and king;

d) assigning a predetermined value to each card with the deuce through ten having values of two through ten respectively, the ace having either a value of one or eleven whichever would give the higher value to a hand, and all face cards of each suit having a value of zero;

e) shuffling the deck(s) so as to randomly mix the array of cards;

f) allowing each player to place a bet on the respective player's hand to beat the dealer's hand;

g) dealing the first card from the shuffled deck(s) face down as a void card;

h) dealing in clockwise fashion to each player a first card, wherein the cards dealt are all face up;

i) dealing to the dealer a first card face up;

j) dealing in clockwise fashion to each player a second card, wherein the cards dealt are all face up;

k) dealing to the dealer a second card face down;

l) allowing each player to place additional wagers on (i) the respective player's hand to win over the dealer's hand, (ii) the respective player's hand to hold three of a kind or trio, or (iii) the respective player's hand to contain a set of face cards from the same suit or royal family before changing cards and drawing a replacement card consistent with house rules for the present invention;

m) allowing each player to stay or change one card;

n) allowing the dealer only to see the value of the dealer hand card dealt face down;

o) changing a card if appropriate, first for each player's hand and, once all players have had an opportunity to change cards, then for the dealer's hand according to house rules for the present invention;

p) determining the wining hand for each player-dealer hand combination by comparing hands, wherein the winning hand is the hand with the higher point total with eleven being the maximum total points possible under the present invention, and wherein a set of three of a kind cards, or trio, or a set of face cards from the same suit, or royal family, beat the highest point total;

q) declaring a draw or tie in the event both the player's hand and the dealer's hand have the same point total or both are a trio or royal family, wherein the wagered amounts are retained in the same categories for the next betting hand;

r) declaring an automatic loss to the dealer if the player's final point total is zero;

s) awarding the winning status for each game player-dealer hand;

t) paying each slayer for successful wagers;

u) paying the dealer for each unsuccessful player wager; and v) leaving any bets on hands resulting in ties in the betting box;

wherein the house rules further comprise:

1) for any two card combination of card 2, card 3 and card 4 change the higher numerical card value;

2) for any card paired with a face card or an Ace card, change the card;

3) for any card paired with card 5 or card 6, change card 5 or card 6, and if card 5 is paired with card 6 change card 5;

4) for all other card combinations not mentioned above change the card with a lower numerical card value, with the following exemptions:
   i) card 7 and card 2, change card 7;
   ii) card 8 and card 2, change card 2, except if the lowest points of the player is 9 points, then change card 8; and
   iii) card 7 and card 3, change card 3, except if the lowest points of the player is 8 points, then change card 7.

7. The improved casino card game method of claim 6 wherein winning player wagers are paid (i) even money for each winning player hand, (ii) 10 to 1 for each successful trio wager 10 to 1, and (iii) 15 to 1 for each successful royal family wager.

8. The improved casino card game and method of claim 7 using computer generated play, wherein up to seven players participate on-line with a computer generated dealer hand.

9. The improved casino card game and method of claim 7 using computer generated play, wherein each player participates on an electronic gaming machine with a computer generated dealer hand.

10. An improved casino card game and method comprising the steps of:

a) providing a guest hand position;

b) providing a house hand position;

c) providing up to seven players;

d) providing a dealer;

e) providing at least one, but not more than eight, standard deck(s) of cards, each deck comprising a four by thirteen array wherein four different suits are arranged in ascending order by numerical indicia wherein each suit has thirteen cards corresponding in order from ace through ten, and three face cards, jack, queen, and king;

f) assigning a predetermined value to each card with the deuce through ten having values of two through ten respectively, the ace having either a value of one or eleven whichever would give the higher value to a hand, and all face cards of each suit having a value of zero;

g) shuffling the deck(s) so as to randomly mix the array of cards;

h) allowing the players to place bets on the house hand or the guest hand to win or on a tie between the house and guest hand;

i) dealing the first card from the shuffled deck(s) face down as a void card;

j) dealing to the guest hand a first card, wherein the card is face up;

k) dealing to the house hand a first card, wherein the card is face up;

l) dealing to the guest hand a second card, wherein the card is face up;

m) dealing to the house hand a second card, wherein the card is face up;

n) counting the values for the guest and house hands by subtracting the differing numerical values of the two cards according to the predetermined values assigned;

o) allowing each player to place additional wagers on (i) either the guest or the house hand to win, (ii) either the guest or house hand to hold three of a kind or trio, (iii) either the guest or house hand to contain a set of face cards from the same suit or royal family, or (iv) on a tie between the guest hand and the house hand before changing cards and drawing a replacement card consistent with house rules for the present invention;

p) declaring a natural death if either the guest hand or the house hand initial points seem impossible to win over the other hand wherein the losing hand automatically loses its wager;

q) changing cards if appropriate, first for the guest hand and then for the house hand according to the house rules for the present invention, wherein the house rules further comprise:
   i) for any two card combination of card 2, card 3 and card 4 change the higher numerical card value;
   ii) for any card paired with a face card or an Ace change the card;
   iii) for any card paired with card 5 or card 6, change card 5 or card 6, and if card 5 is paired with card 6 change card 5;
   iv) for all other card combinations not mentioned above change the card with a lower numerical card value, with the following exemptions:
      card 7 and card 2, then change card 7;
      card 8 and card 2, change card 2, except if the points of the guest hand or house hand equal 9 points, then change card 8; and
      card 7 and card 3, then change card 3, except if the points of the guest hand or the house hand equal 8 points, then change card 7;

r) determining the wining hand by comparing hands, wherein the winning hand is the hand with the higher point total for the two existing cards in each hand, any changed card no longer being part of the game, with eleven being the maximum total points possible under the present invention, and wherein a set of three of a kind cards, or trio, or a set of face cards from the same suit, or royal family, beat the highest point total;

s) declaring a draw or tie in the event both the guest hand and the house hand have the same point total or both are a trio or royal family;

t) declaring an automatic loss to the house if the guest hand final point total is zero;

u) awarding the winning status for the hand;

v) paying each player for each winning wager (i) even money for each winning wager on a guest hand, (ii) even money less a five (5%) percent house commission for each winning wager on a house hand, (iii) 8 to 1 for each successful tie wager, (iv) 10 to 1 for each successful trio wager, and (v) 15 to 1 for each successful royal family wager; and w) paying the house for each unsuccessful player wager.

11. An improved casino card game and method comprising the steps of:

a) providing a dealer hand position;

b) providing up to seven players, each with a player hand position;

c) providing at least one, but not more than eight, standard deck(s) of cards, each deck comprising a four by thirteen array wherein four different suits are arranged in ascending order by numerical indicia wherein each suit has thirteen cards corresponding in order from ace through ten, and three face cards, jack, queen, and king;

d) assigning a predetermined value to each card with the deuce through ten having values of two through ten respectively, the ace having either a value of one or eleven whichever would give the higher value to a hand, and all face cards of each suit having a value of zero;

e) shuffling the deck(s) so as to randomly mix the array of cards;

f) allowing each player to place a bet on the respective player's hand to beat the dealer's hand;

g) dealing the first card from the shuffled deck(s) face down as a void card;

h) dealing in clockwise fashion to each player a first card, wherein the cards dealt are all face up;

i) dealing to the dealer a first card face up;

j) dealing in clockwise fashion to each player a second card, wherein the cards dealt are all face up;

k) dealing to the dealer a second card face down;

l) allowing each player to place additional wagers on (i) the respective player's hand to win over the dealer's hand, (ii) the respective player's hand to hold three of a kind or trio, or (iii) the respective player's hand to contain a set of face cards from the same suit or royal family before changing cards and drawing a replacement card consistent with house rules for the present invention;

m) allowing each player to stay or change one card;

n) allowing the dealer only to see the value of the dealer hand card dealt face down;

o) changing a card if appropriate, first for each player's hand and, once all players have had an opportunity to change cards, then for the dealer's hand according to house rules for the present invention comprising;

i) for any two card combination of card 2, card 3 and card 4 change the higher numerical card value;

ii) for any card paired with a face card or an Ace change the card;

iii) for any card paired with card 5 or card 6, change card 5 or card 6, and if card 5 is paired with card 6 change card 5;

iv) for all other card combinations not mentioned above change the card with a lower numerical card value, with the following exemptions:

card 7 and card 2, then change card 7;

card 8 and card 2, change card 2, except if the points of the guest hand or house hand equal 9 points, then change card 8; and card 7 and card 3, then change card 3, except if the points of the guest hand or the house hand equal 8 points, then change card 7;

p) determining the wining hand for each player-dealer hand combination by comparing hands, wherein the winning hand is the hand with the higher point total for the two existing cards in each hand, any changed card no longer being part of the game, with eleven being the maximum total points possible under the present invention, and wherein a set of three of a kind cards, or trio, or a set of face cards from the same suit, or royal family, beat the highest point total;

q) declaring a draw or tie in the event both the player's hand and the dealer's hand have the same point total or both are a trio or royal family, wherein the wagered amounts are retained in the same categories for the next betting hand;

r) declaring an automatic loss to the dealer if the player's final point total is zero;

s) awarding the winning status for each game player-dealer hand;

t) paying each player for successful wagers at (i) even money for each winning player hand, (ii) 10 to 1 for each successful trio wager 10 to 1, and (iii) 15 to 1 for each successful royal family wager;

u) paying the dealer for each unsuccessful player wager; and v) leaving any bets on hands resulting in ties in the betting box.

* * * * *